United States Patent [19]

Saito et al.

[11] 3,949,240

[45] Apr. 6, 1976

[54] SWITCHING CIRCUIT FOR POWER SUPPLY TO ELECTRONIC APPARATUS

[75] Inventors: Takahiko Saito, Kamakura; Takeshi Murata, Yokohama; Satoshi Mimura, Chigasaki, all of Japan

[73] Assignee: Sony Corporation, Tokyo, Japan

[22] Filed: Nov. 19, 1973

[21] Appl. No.: 417,415

[30] Foreign Application Priority Data

Nov. 24, 1972 Japan ..... 47-117777

[52] U.S. Cl. ..... 307/141; 58/38 R; 58/152 B; 317/141 S; 325/396

[51] Int. Cl.[2] ..... H01H 7/00; H01H 43/00

[58] Field of Search ..... 325/396; 200/35 B, 38 FB, 200/38 DA, 38 DB; 307/141 R, 141.4, 141.8; 58/152, 38; 317/141 S, 136, DIG. 8; 340/309.1

[56] References Cited

UNITED STATES PATENTS

| | | | |
|---|---|---|---|
| 3,041,477 | 6/1962 | Budts et al. | 317/DIG. 8 |
| 3,348,008 | 10/1967 | Miller | 307/141.8 |
| 3,577,004 | 5/1971 | Tsoutsas | 307/141 |

*Primary Examiner*—David Smith, Jr.
*Attorney, Agent, or Firm*—Hill, Gross, Simpson, Van Santen, Steadman, Chiara & Simpson

[57] ABSTRACT

A switching circuit for the power supply of electronic apparatus, such as a radio, which includes a pair of flip-flop circuits, a clock set time switch for turning the apparatus on once every 24 hours for a short period of time, a sleep time switch which may keep the apparatus on for a short period of time without interfering with the functioning of the clock set time switch, a change of mode switch which may change the apparatus at any time from an on-state to an off-state or vice versa, and a disabling switch for the clock switch circuit.

3 Claims, 3 Drawing Figures

SWITCHING CIRCUIT FOR POWER SUPPLY TO ELECTRONIC APPARATUS

BACKGROUND OF THE INVENTION

1. Field of the Invention

This invention relates generally to an electronic apparatus with a timer, and more particularly to an electronic apparatus with a timer which is automatically placed in an operative or inoperative state by a time switch.

2. Description of the Prior Art

An electronic apparatus with a timer, for example, a radio receiver with a timer or clock has been provided with time setting means which will operate a radio receiver to receive a broadcasting signal, or the oscillator of the radio receiver to make an alarm at a set time, and with an operating switch or so-called sleep timer which will make the radio receiver inoperative after a predetermined time interval has lapsed.

A typical prior art radio receiver with a timer will be now described with reference to FIG. 1.

In FIG. 1, reference numeral 55 generally indicates a radio receiver 55 with a timer, 1 its housing, and 1*a*, 1*b* and 1*c* an upper panel, left side panel and right side panel thereof, respectively. The radio receiver 55 has a dial plate 5 which has a pointer 6. A timer or clock 9, which consists of hour indication leaves 7 and minute indication leaves 8, is housed in the radio receiver 55. A set time indicator drum 10 of a time setting device or so-called 24 hour timer is also housed in the radio receiver 55. The time setting device includes a set time indicating mark 11. The elements 5 to 11 can be seen through windows formed in a front panel 2 of the radio receiver 55.

In FIG. 1, reference numerals 12*a* and 12*b* designate a tuning dial knob and a volume adjusting knob provided on the right side panel 1*c* of the housing of the radio receiver 55; 13 a time adjusting knob provided on the left side panel 1*b* of the housing 1, the leaves 7 and 8 of the clock 9 being turned over by rotating the knob 13; and 14 a time setting knob of the time setting device provided coaxially with the knob 13 on the left side panel 1*b* of the housing 1, the set time indicator drum 10 being rotated to be adjusted by rotating the knob 14. A rod knob 15 for the operating switch or the sleep timer is further provided on the upper panel 1*a* of the housing 1. The rod knob 15 has formed thereon a time scale and the sleep timer is set by drawing out the rod knob 15 from the housing 1. That is, the sleep timer is set in accordance with the length of the drawn out portion of the rod knob 15, and the drawn out rod knob 15 returns into the housing 1 as the time lapse. Accordingly, when the rod knob 15 returns to its initial position as the set time interval has lapsed or is forcibly pushed into the housing 1 to its initial position, the sleep timer is released to make the radio receiver 55 inoperative.

The radio receiver 55 has provided on its upper panel 1*a* a push-and-push button 16 for setting and releasing the time setting device. In this case, when the clock 9 comes to the appointed time by the time setting device, the radio receiver 55 is made operative to produce a sound, but thereafter if the radio receiver 55 will be left as it is, it will be made inoperative after, for example, one hour to stop its sound production. Further, a push-and-push button 17 which is manually operated is provided on the upper panel 1*a* of the housing 1 for making the radio receiver 55 operative and inoperative.

When the prior art radio receiver 55 is used as an alarm clock, if the button 16 of the time setting device is pushed down to set it before a user sleeps (in this case, the button 17 is reset) and the time indicator drum 10 is set at an appointed time when the user will wake up tomorrow morning, the time switch will operate to make the radio receiver 55 operative and hence the radio receiver 55 will produce a sound at that time to wake up the user.

If the user once awakens, the sound generation by the radio receiver 55 is not required. However, the radio receiver 55 will keep its sound production for 1 hour. If it is desired to stop the sound production, the button 16 must be pushed to be released. However, if the button 16 is left as it is released, the radio receiver 55 can not produce any sound at the appointed time the next morning and hence the user can not awaken.

Further, in order to cause the radio receiver 55 to be turned on by drawing out the rod knob 15 so as to turn the sleep time switch on, and to thereafter cause the radio receiver 55 to be made inoperative before the time determined by the sleep time switch, it is necessary to insert the rod knob 15 of the sleep time switch into the housing 1. In order to cause the radio receiver 55 to be turned on at the time set by the indicator drum 10 by setting the button 16 and to cause the radio receiver 15 to be made inoperative before the predetermined time, the button 16 must be pushed down to be released. In such case, the radio receiver 55 can not be put into an inoperative state by the button 17 of the manual switch.

SUMMARY OF THE INVENTION

A switching circuit for the power supply to an electronic apparatus which includes a timer for pre-setting the time at which the power supply is turned on to the electronic apparatus, means for automatically turning the power supply off after a predetermined period following the time when the apparatus has been turned on by the timer and which further includes means for turning the power supply on and off irrespective of the setting of the timer and which will not prevent the timer from turning the apparatus back on again when the next cycle of the timer takes place. The circuit also has an operating device for reversing its state at a set time by a time setting device. Means is provided such that the electronic apparatus can be made inoperative by operating the operating device to turn off the time switch but without causing the time setting device to be released.

It is an object of the present invention to provide an electronic apparatus with a timer which is free from the defects of the prior art.

Another object of the invention is to provide an electronic apparatus with a timer in which power supply to the electronic apparatus is controlled by an operating device for reversing the same irrespective of on or off state of a time switch.

A further object of the invention is to provide an electronic apparatus with a timer in which the electronic apparatus can be made operative or inoperative easily in any state.

The additional and other objects, features and advantages of the invention will become apparent from the following description taken in conjunction with the accompanying drawings.

Figure 1:
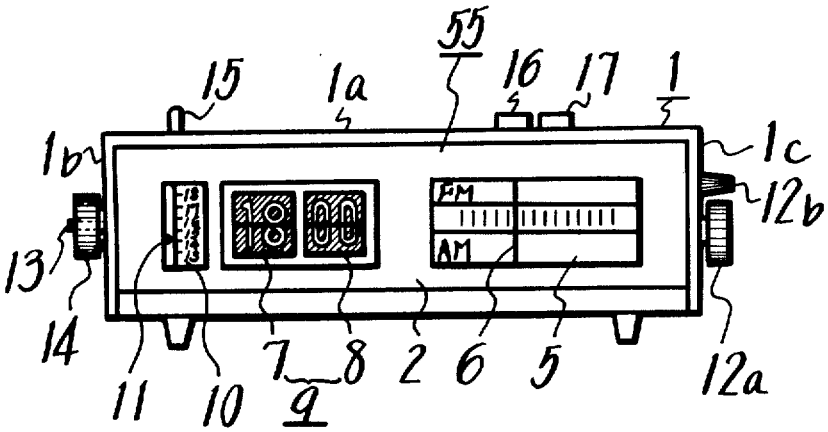
Fig. 1 (PRIOR ART)
FIG. 1 is a front view of a representative prior art radio receiver with a clock.
Figure 2:
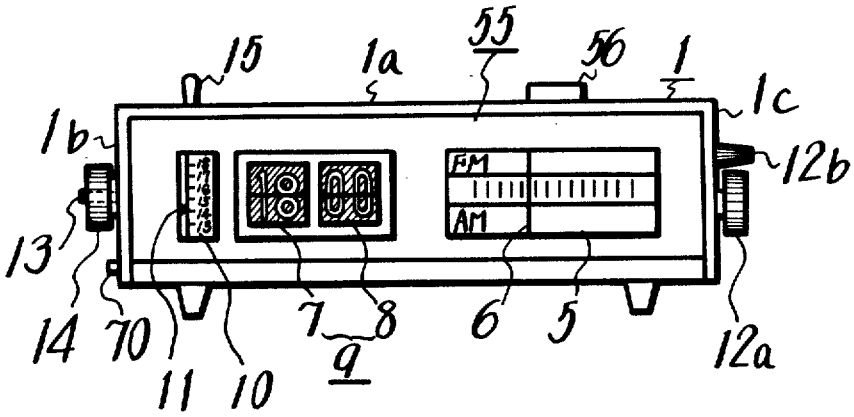
FIG. 2 is a front view illustrating a preferred embodiment of the present invention.
Figure 3:
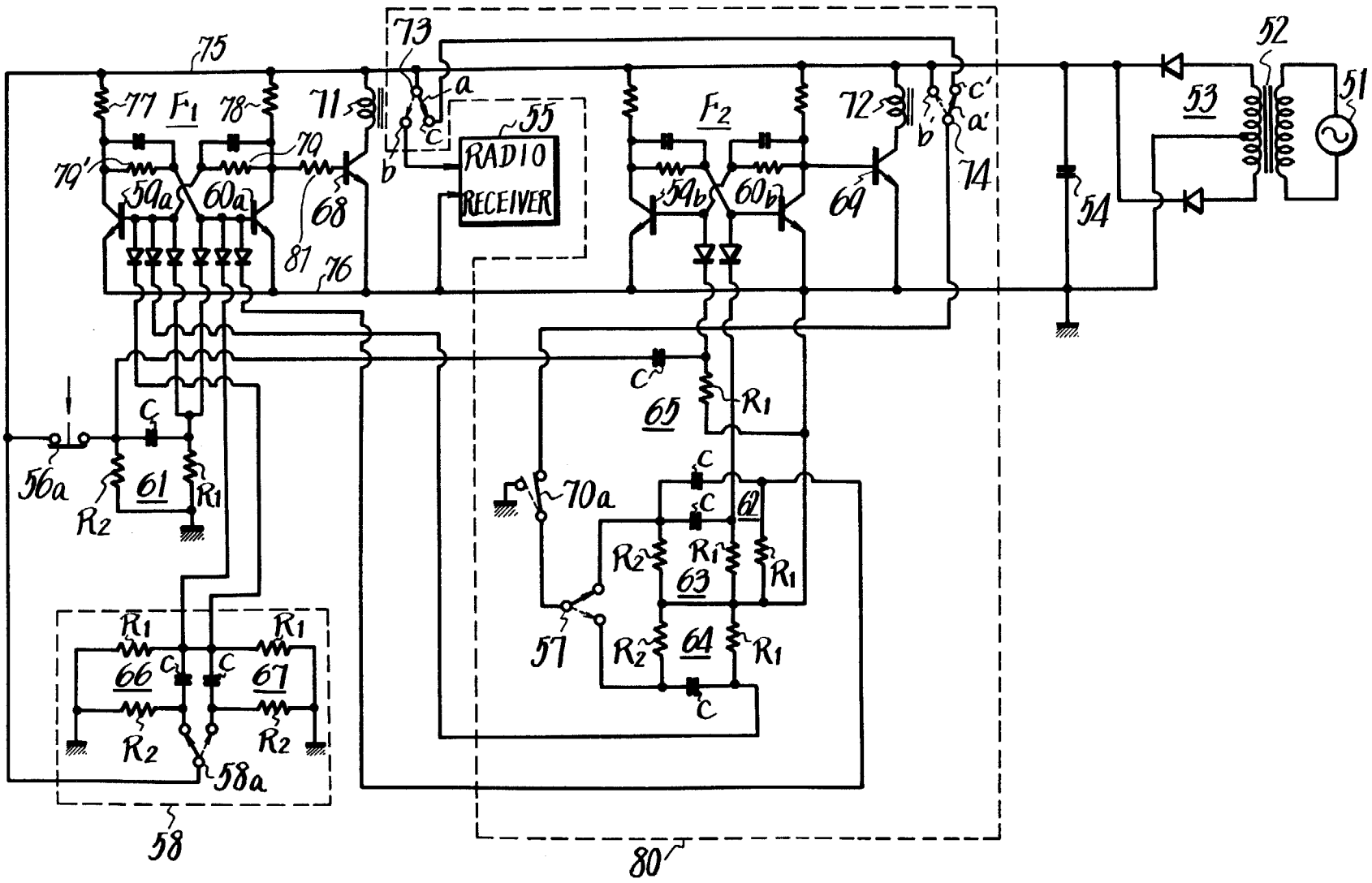
FIG. 3 is a schematic wiring diagram of a switching circuit for a power supply to electronic apparatus such as to the radio receiver shown in FIG. 2.

DESCRIPTION OF A PREFERRED EMBODIMENT the illustrated preferred embodiment of the invention as shown in FIGS. 2 and 3 includes a radio receiver 55 which receives power through a power supply circuit including an alternating current source 51, a transformer 52 and a full wave rectifier 53. A smoothing capacitor 54 is employed in the power supply circuit, as shown. A solenoid operated switch 73 controls the power supply to the radio receiver 55. This switch 73 has a movable contact *a* and two stationary contacts *b* and *c*. Contact *b* directly connects with the radio receiver 55 for connecting a voltage source thereto, the other side of the voltage source being grounded, as shown in FIG. 3. Movable contact *a* of switch 73 is normally biased to the stationary contact *c*, which contact is directly connected to a stationary contact *c'* of a solenoid actuated switch 74. Switch 74 has a movable contact *a'* normally biased to contact with *c'*, and a second stationary contact *b'*, the latter being connected to the voltage source. Switches 73 and 74 are provided with solenoids 71 and 72, respectively, for shifting the movable contacts *a* and *a'* from their biased position against stationary contacts *c* and *c'*, respectively (as shown by full lines) to their respective positions against stationary contacts *b* and *b'* (as shown in dotted line). Before proceeding further with reference to the manner in which the radio receiver 55, attention is directed to FIG. 2 which shows generally a radio receiver embodying the present invention. The external appearance is generally similar to that shown in FIG. 1, but it will be noted that the push button switches 16 and 17 of FIG. 1 have been replaced by a push button switch 56, which will hereinafter be referred to in detail in connection with the movable contact 56*a* shown in FIG. 3. Furthermore, a push button 70 is shown for actuating a switch 70*a* later to be described in connection with FIG. 3.

Since it is the purpose of the present invention to provide a variety of switching possibilities and to retain in a memory certain pre-set timing controls, two bistable multi vibrator circuits $F_1$ and $F_2$ (hereinafter referred to as flip-flops) are provided. The flip-flops $F_1$ and $F_2$ are connected between a conductor 75 from the main positive source of voltage and a conductor 76 which is connected to ground. Flip-flop $F_1$ includes a pair of transistors 59*a* and 60*a* whose respective collectors are connected through resistors 77 and 78 to conductor 75. The emitters of both transistors 59*a* and 60*a* are connected to ground through conductor 76. The base of transistor 59*a* is connected through a resistor 79 to the collector of transistor 60*a*, while the base of transistor 60*a* is connected through resistor 79' to the collector of transistor 59*a*. The usual capacitors are employed in shunt with resistors 79 and 79'. The output circuit of the flip-flop $F_1$ is provided by connecting the collector of transistor 60*a* through a resistor 81 to the base of an output transistor 68. The collector emitter circuit of transistor 68 is connected through the solenoid 71 of switch 73 between power supply conductor 75 and the ground conductor 76. It will, of course, be understood that the flip-flop $F_1$ has two stable states. To control the change of state of the flip-flop $F_1$ trigger circuits (hereinafter to be further described) are connected through diodes to the bases of transistors 59*a* and 60*a*.

The second flip-flop circuit $F_2$ similarly includes a pair of transistors 59*b* and 60*b* with the base electrode of one connected to the collector electrode of the other. Trigger circuits (hereinafter to be further described) are connected through diodes to the base electrodes of transistors 59*b* and 60*b*.

All switches shown in FIG. 3 are normally biased to the positions shown by a full line for the movable contact.

Referring now to a further description of the circuit, the change of mode non-lock push button 56 (FIG. 2) actuates a movable switch element 56*a* which is normally biased to its closed position. As hereinbefore indicated, a number of trigger circuits are provided and these each include different pairs of resistors $R_1$ and $R_2$ and capacitors C. One trigger circuit 61 is provided for use in conjunction with the movable contact 56*a*. A second set of trigger circuits 66 and 67 are provided for use in conjunction with a sleep time switch circuit 58. Four additional trigger circuits 62, 63, 64 and 65 are also provided. For use in conjunction with a clock set time switch 57, trigger circuits 62 and 65 are provided for use in conjunction with flip-flop $F_1$, while trigger circuits 63 and 64 are provided for use in conjunction with flip-flop $F_2$.

The push button 56 has its associated movable contact 56*a* normally closed to be on, but is opened by pushing the movable contact to its open position through the button 56 on the upper panel 1*a* of the housing 1. A clock set time switch 57 is provided which is normally biased as shown in FIG. 3 by a solid line. The movable contact of this switch is moved to its other position as shown by the broken line in FIG. 3, when the time indicator drum 10 arrives at a time indicated by the indication mark 11, such for example as 7:00 AM, the clock set switch 57 is moved to its position as shown by the dotted line in FIG. 3, and is returned to its original state or position after a predetermiined time interval, such for example, 1 hour. This operation is repeated every 24 hours.

A sleep-time circuit 58 consisting of a sleep-time switch 58*a* and two trigger signal generators 66 and 67 are provided. The sleep-time switch 58*a* is normally in the position shown by the solid line in FIG. 3, but is switched to the position shown by the dotted line by pulling up the operating rod knob 15 (FIG. 2). The sleep-time switch 58*a* is then lowered gradually by the clock mechanism (not shown) until it reaches its normally biased stationary position (its off-state) after a time period (for example, 30 minutes) which corresponds to the drawn out amount of the rod knob 15. It is to be noted that this functioning has no effect on the functioning of the clock set time switch and vice versa.

Switches 57 and 58 which are driven as mentioned above by a mechanism (not shown) which is associated with the clock 9, housed in the radio receiver 55, are not released or altered by the opening or closing of the change of mode switch 56*a*.

At one stable state of the flip-flop $F_1$, the transistor 59*a* is on, the transistor 60*a* is off, which in turn causes the transistor 68 to be turned on, thus causing current to flow through the solenoid 71. This causes the movable contact *a* to move to its dotted line position, thus connecting the radio receiver directly to the power supply line 75. At the other stable state flip-flop $F_1$ (which may be referred to as the reset state), the solenoid 71 is de-energized and the movable contact *a* of switch 73 moves to its full line position. This, of course, renders the radio receiver 55 inoperative.

When the transistor 59*b* of the second flip-flop $F_2$ is turned on, and its other transistor 60*b* goes off, the transistor 69 is turned on to energize the solenoid 72. This causes its movable contact *a'* to move to its dotted line position against the stationary contact *b* of the substitute power source switch 74. It will be noted that the stationary contact *b'* of switch 74 is directly connected to the power supply line 75 while the stationary contact *c'* of switch 74 is connected to the stationary contact *c* of switch 73. The other stable state of the flip-flop circuit $F_2$ in which the movable contact *a'* contacts the stationary contact *c'* of switch 74, will hereinafter be referred to as the reset state.

When the flip-flop circuit $F_2$ is in its first stable state, a voltage is applied through the clock set time switch 57 to the second and third trigger signal generators 62 and 63 or through the fourth trigger signal generator 64, in accordance with the switching condition of the switch 57, to place the same in standby condition for signal generation.

In order to reverse the state of the flip-flop circuit $F_1$ at every operation of the change of mode switch 56*a*, the first trigger signal generator 61 is connected to the flip-flop circuit F1. Further, in order to transfer the flip-flop circuit $F_1$ from its non-stationary state caused by the time switch 57 to its set state, the second trigger signal generator 62 is connected through a diode to the base electrode of the transistor 60*a* of the flip-flop circuit $F_1$. In order to place the flip-flop circuit $F_1$ in its reset state when the time switch 57 is switched to the stationary state, the fourth trigger signal generator 64 is connected through a diode to the base electrode of the transistor 59*a*.

In order to prevent the flip-flop circuit $F_1$ from being reset and hence disconnect the radio receiver 55 when the time switch 57 is put in its dotted line position, and to thereafter return to the full line position during the time interval when the flip-flop circuit $F_1$ is in its set state, or the switch 56*a* operates to make the radio receiver 55 operative, the time switch 57 is supplied with current by changing the movable contact *a* of the switch 73 to contact with the fixed contact *c* to stop the operation of the trigger signal generators 62 and 63 or the trigger signal generator 64 when the flip-flop circuit $F_1$ is set once.

However, in order to make it possible for the flip-flop circuit $F_1$ to be set by the fact that the time switch 57 is switched to the non-stationary state, when the radio receiver 55 is inoperative, and the trigger signal is supplied from the fourth trigger signal generator 64 to the base electrode of the transistor 59*a* in the flip-flop circuit $F_1$ when the time switch 57 returns to the stationary state, the capacitor C of the fourth trigger signal generator 64 is charged up through the contacts *c'* and *a'* of the switch 74 which are operated by the relay 72. Accordingly, in this case when the time switch 57 is changed to its non-stationary state, the trigger signal from the first trigger signal generator 63 is used to place the flip-flop circuit $F_2$ in its set state to energize the relay 72. Thus, when the time switch 57 moves one stroke cycle, the flip-flop circuit $F_1$ is set and then reset. The flip-flop circuit $F_2$ is reset by applying to the base electrode of its transistor 59*b* through a diode a trigger signal from the fifth trigger signal generator 65 by operating the change of mode switch 56*a*.

Accordingly, when the radio receiver 55 is inoperative and the appointed time of the time setting device is reached, the time switch 57 is changed to its non-stationary state (its dotted line position) and hence the second and third trigger signal generators 62 and 63 produce trigger signals, respectively, which are used to put the flip-flop circuits $F_1$ and $F_2$ in their set state, respectively. Then, the radio receiver 55 is made operative by the relays 71 and 72. At the same time, the movable contact *a'* of the switch 74 is made to contact its fixed contact *b'* to supply power to the time switch 57. At this condition, the operating device 56 is operated to supply a trigger pulse from the first trigger pulse generator 61 to the flip-flop circuit $F_1$. Thus, the flip-flop circuit $F_1$ is transferred in state and hence the radio receiver 55 is put into an inoperative state. However, when the appointed time after 24 hours is arrived at, the time switch 57 is placed in a non-stationary state (the dotted line position) to make the radio receiver 55 operative. This is done by a control circuit 80 consisting of the switches 73, 74, the flip-flop circuit $F_2$ and the second to fourth trigger signal generators 62 to 64. That is, by operating the operating device 56, the fifth trigger signal generator 65 supplies a trigger signal to the flip-flop circuit $F_2$ for resetting the latter. Thus, the relay 72 is de-energized and the movable contact *a'* of the switch 74 contacts with its other fixed contact *c'*. However, due to the flip-flop circuit $F_1$ which is reset, the relay 71 is de-energized and hence the movable contact *a* of the switch 73 contacts its other fixed contact *c*. Thus, the power is applied to the time switch 57 through the movable contact *a*, the fixed contact *c*, the fixed contact *c'*, and the movable contact *a'*, so that the second and third trigger signal generators 62 and 63 or the fourth trigger signal generator 64 are supplied with current. Thus, when the time switch 57 is switched to non-stationary state the next time, the second and third trigger signal generators 62 and 63 or the fourth trigger signal generator 64 are placed in standby for trigger signal generation.

Further, if the sleep time switch 58*a* is changed to the non-stationary state, the trigger signal from the sixth trigger signal generator 66 is applied through a diode to the base electrode of the transistor 60*a* in the flip-flop circuit $F_1$ to put the latter in its set state and hence the radio receiver 55 can be operated. After a predetermined time interval, if the sleep time switch 58*a* returns to the stationary state, the trigger signal is supplied from the seventh trigger signal generator 67 to the base electrode of the transistor 59*a* in the flip-flop circuit $F_1$ to being the latter to the reset state.

With the present invention described as above, every time when the switch 56*a* is operated, the radio receiver 55 can be made operative or inoperative. Further, during inoperation, the radio receiver 55 can be automatically made operative for a predetermined time interval at an appointed time by operating the time switch 57. In this case, after the radio receiver 55 has been operated by the switch 56*a*, the radio receiver 55 is not changed in operation even if the time switch 57 is changed in any manner.

It is possible that after the time switch 57 is switched to the non-stationary state and the radio receiver 55 is operated, the switch 56*a* may be operated to reset the flip-flop circuit $F_1$ and hence to make the radio receiver 55 inoperative. It is, of course, possible for the radio receiver 55 to be made operative again by operating the switch 56*a* after it has been made inoperative. Further, even if the radio receiver 55 is made inoperative by the switch 56*a* after it has been made opeative by the time switch 57, the radio receiver 55 can be made operative at the next appointed time by the time switch 57 and thereafter inoperative.

In practice, the radio receiver 55 is made operative by operating the sleep-time switch 58*a* and then inoperative after the time set by the sleep timer. It is, of course, possible that after the radio receiver 55 has been made operative by the sleep-time switch 58*a*, for it to be made inoperative by the power switch 56*a*. Further, if the radio receiver 55 is made operative by the power switch 56*a* and thereafter the sleep-time switch 58*a* is set to the non-stationary state, the radio receiver 55 will be made inoperative by the sleep-time switch 58*a* after the time interval, corresponding to the drawn out amount of the rod knob 15, will have lapsed.

In FIG. 2, reference numeral 70 designates a knob of a change over switch for controlling the time switch 57 which knob is provided on the outside of the housing 1. When the switch 70 is changed to position its movable contact 70*a* as shown by a dotted line in FIG. 3, and the time switch 57 is moved between the positions shown by dotted and solid lines in FIG. 3 by the clock 9 from mechanical point of view, no power is applied to the second, third and fourth trigger signal generators 62, 63 and 64, and hence the flip-flop circuits $F_1$ and $F_2$ can not be reversed. That is, this operation is to make the time switch 57 inoperative and the radio receiver 55 is not operated by the time switch 57.

As described above, with the present invention the radio receiver 55 is manually made operative finally, so that the whole operation becomes simple. In addition, only when the radio receiver 55 is off may it be made operative by the time switch 57.

The radio receiver with a clock is exemplified in the foregoing as the electronic apparatus with a timer of the present invention, but it may be apparent that other electronic apparatus such as a tape recorder, television receiver, a record player or the like with a sound producing device can be considered as the electronic apparatus with a timer of the present invention. Accordingly, the scope of the invention should be determined by the appended claims only.

We claim as our invention:

1. A switching circuit for applying power from a power supply to an electronic audio apparatus in accordance with the settings of a change of mode switch, a sleep time switch, and an awakening clock switch, comprising:

a. a first switching means connected between the power supply and said electronic apparatus;
b. a first bistable means connected to said first switching means for controlling the same;
c. a change of mode switch connected to the first bistable means for triggering said first bistable means to turn the apparatus on and off in response to actuation of the change of mode switch;
d. a sleep time circuit switch means connected to the first bistable means for triggering said bistable means in response to its setting;
e. awakening circuit clock switch means connected to the first bistable means for triggering said bistable means in response to its setting;
f. a change over switch connected to said awakening clock switch means;
g. a fifth switch means connected to the change over switch for supplying power to the awakening circuit clock switch means and connected to said power supply and to said first switching means;
h. a second bistable means connected to said fifth switch means to control it and said second bistable means connected to awakening circuit clock switch means and said change of mode switch.

2. A switching circuit for applying power from a power supply to an electronic audio apparatus in accordance with the settings of a change of mode switch, a sleep time switch, and an awakening clock switch, comprising:

a. a first switching means connected between the power supply and said electronic apparatus;
b. a first bistable means connected to said first switching means for controlling the same;
c. a change of mode switch connected to the first bistable means for triggering said first bistable means to turn the apparatus on and off in response to actuation of the change of mode switch;
d. a sleep time circuit switch means connected to the first bistable means for triggering said bistable means in response to its setting;
e. awakening circuit clock switch means connected to the first bistable means for triggering said bistable means in response to its setting;
f. a change over switch connected to said awakening clock switch means;
g. a fifth switch means connected to the change over switch for supplying power to the awakening circuit clock switch means and connected to said power supply and to said first switching means;
h. a second bistable means connected to said fifth switch means to control it and said second bistable means connected to awakening circuit clock switch means and said change of mode switch, wherein said first and second bistable means are first and second flip-flop circuits, a first solenoid controlled by said first flip-flop circuit and connected to said first switching means, and a second solenoid controlled by said second flip-flop circuit and connected to said fifth switching means.

3. A switching circuit for applying power from a power supply to an electronic audio apparatus in accordance with the settings of a change of mode switch, a sleep time switch, and an awakening clock switch, comprising:

a. a first switching means connected between the power supply and said electronic apparatus;
b. a first bistable means connected to said first switching means for controlling the same;
c. a change of mode switch connected to the first bistable means for triggering said first bistable means to turn the apparatus on and off in response to actuation of the change of mode switch;
d. a sleep time circuit switch means connected to the first bistable means for triggering said bistable means in response to its setting;
e. awakening circuit clock switch means connected to the first bistable means for triggering said bistable means in response to its setting;

f. a change over switch connected to said awakening clock switch means;

g. a fifth switch means connected to the change over switch for supplying power to the awakening circuit clock switch means and connected to said power supply and to said first switching means;

h. a second bistable means connected to said fifth switch means to control it and said second bistable means connected to awakening circuit clock switch means and said change of mode switch including a first trigger signal generator connected between said change of mode switch and said first bistable means, a first solenoid controlled by said first bistable means and connected to said first switching means, a second trigger circuit connected beween said awakening circuit clock switch and said second bistable means, and a second solenoid controlled by said second bistable means and connected to said fifth switching means.

* * * * *